US007357670B2

(12) United States Patent
Tanaka

(10) Patent No.: US 7,357,670 B2
(45) Date of Patent: Apr. 15, 2008

(54) CONNECTOR FOR USE IN SUBSTRATE

(75) Inventor: Nobuyoshi Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/656,719

(22) Filed: Jan. 23, 2007

(65) Prior Publication Data

US 2007/0197059 A1 Aug. 23, 2007

(30) Foreign Application Priority Data

Feb. 20, 2006 (JP) ..... 2006-042865

(51) Int. Cl.
*H01R 13/60* (2006.01)

(52) U.S. Cl. ..... 439/567; 439/79

(58) Field of Classification Search ..... 439/79–82, 439/84, 570–571, 567, 557
See application file for complete search history.

(56) References Cited

U.S. PATENT DOCUMENTS 5,980,314 A * 11/1999 Roberts ..... 439/567

FOREIGN PATENT DOCUMENTS

JP 8-148241 6/1996

* cited by examiner

*Primary Examiner*—Javaid H. Nasri
(74) *Attorney, Agent, or Firm*—Gerald E. Hespos; Anthony J. Casella

(57) ABSTRACT

A fixing part (12) has two resiliently deformable legs (18) separated by a slot (17). A locking projection (19) is formed at a distal end (19C) of the fixing part (12) and has a locking surface (19A) spaced from the distal end (19C). A maximum cross-sectional dimension (A) of the fixing part (12) at the locking surface (19A) exceeds the diameter (d) of a through-hole (71) in a substrate (70). A tapered sliding-contact surface (19B) extends from the locking surface (19A) to the distal end (19C). Noncontact surfaces (21) are at opposite circumferential ends of each sliding contact surface (19B) and substantially adjacent the slot (17). The noncontact surfaces (22) of each locking projection (19) are spaced from one another at the slot (17) by distances that are no greater than the diameter (d) of the through-hole (71).

15 Claims, 8 Drawing Sheets

CONNECTOR FOR USE IN SUBSTRATE

BACKGROUND OF THE INVENTION

1. Field of the Invention

The invention relates to a connector for use in a substrate.

2. Description of the Related Art

Japanese Patent Application Laid-Open No. 8-148241 discloses a connector for use in a substrate. The connector has a housing and a fixing part is provided on the housing for mounting the housing on the substrate. The fixing part is inserted through a through-hole that penetrates through the substrate and is fixed to the substrate. More specifically, an expanding slot extends axially from the distal end surface of the fixing part and two legs are defined at the sides of the expanding slot. The legs are deformable towards one another and into the expanding slot. A lock projects at the distal end of each leg in a direction orthogonal to the axis of the fixing part. The locks slide in contact with the through hole and cause the legs to deflect into the expanding slot. Thus, the locks can penetrate through the through-hole of the substrate. The legs restore resiliently when the locks emerge from the through hole and the locks engage the back surface of the substrate.

The edge of the locking projection is formed on the entire periphery of each leg of the known connector. Thus, the entire edge of the locking projection slides in contact with the inner peripheral surface of the through-hole while mounting the housing on the substrate. This construction requires a high insertion force and imposes a burden on the operator. The edge of the locking projection could be removed to avoid this problem. However, the locking area of the projection for locking the housing to the substrate decreases more than a necessary amount, and there is a fear that a force required to hold the housing on the substrate decreases.

The invention was made in view of the above-described situation, and it is an object of the invention to decrease a force required to insert a connector into a substrate while maintaining a force required to hold the connector on the substrate.

SUMMARY OF THE INVENTION

The invention relates to a connector for use with a substrate that is formed with a through hole. The connector has a housing and a fixing part is formed on the housing. An expanding slot extends axially from a distal end of the fixing part and at least two legs are elastically deformable into the expanding slot. A locking projection is formed at a distal end of each leg and projects orthogonal to the axial direction of the fixing part. The locking projections slide in contact with the through-hole as the legs are urged through the through hole, and thus the legs deflect into the expanding slot. The legs restore resiliently when the locking projections emerge from the through hole and the locking projections engage and lock to the rear side of the substrate adjacent the through-hole. At least one noncontact surface is formed on a peripheral surface of the locking projection that confronts a direction orthogonal to a flexing direction of each of the legs. The noncontact surface becomes gradually wider from a distal end of the locking projection to a proximal end thereof and does not contact an inner peripheral surface of the through-hole.

Two noncontact surfaces preferably are disposed respectively at ends of the peripheral surface of the locking projection in a circumferential direction thereof; and adjacent a locking surface of the locking projection to be locked to the substrate. A ridgeline of an inner surface of the expanding slot and a ridgeline of the noncontact surface are continuous with each other without forming a difference in level or step.

The locking projections slide in contact with the inner peripheral surface of the through-hole in the substrate as the fixing part is inserted into the through-hole. This engagement of the locking projections with the inner peripheral surface causes each leg to flex inwardly. However, noncontact portions of the locking projection do not contact the inner peripheral surface of the through-hole. Thus, a force required to insert the fixing part into the substrate is low and operational efficiency is good.

The locking projection penetrates through the through-hole and is locked elastically to the edge of the through-hole at its exit side. The noncontact surface is formed on the peripheral surface of the locking projection at portions that confront the direction orthogonal to the flexing direction of both legs. Thus, the locking area of the locking projection in the flexing direction is not smaller than that of the locking projection of a conventional fixing part, and the force of the fixing part for holding the housing on the substrate does not decrease.

The noncontact surface becomes gradually wider from the distal end of the locking projection to the proximal end thereof. Thus, the legs can be guided smoothly into the through-hole.

The noncontact surfaces are at both ends of the peripheral surface of the locking projection in the circumferential direction thereof. Further, an edge of the inner surface of the expanding slot is continuous with an edge of the noncontact surface at a position of the locking surface of the locking projection without forming a step or difference in level. Therefore, foreign matter will not be caught at the intersection of the above-described edges, and the portion of the locking projection corresponding to the intersection will not break off. In addition, the construction of the locking projection can be simplified.

DETAILED DESCRIPTION OF THE PREFERRED EMBODIMENTS

Figure 1:
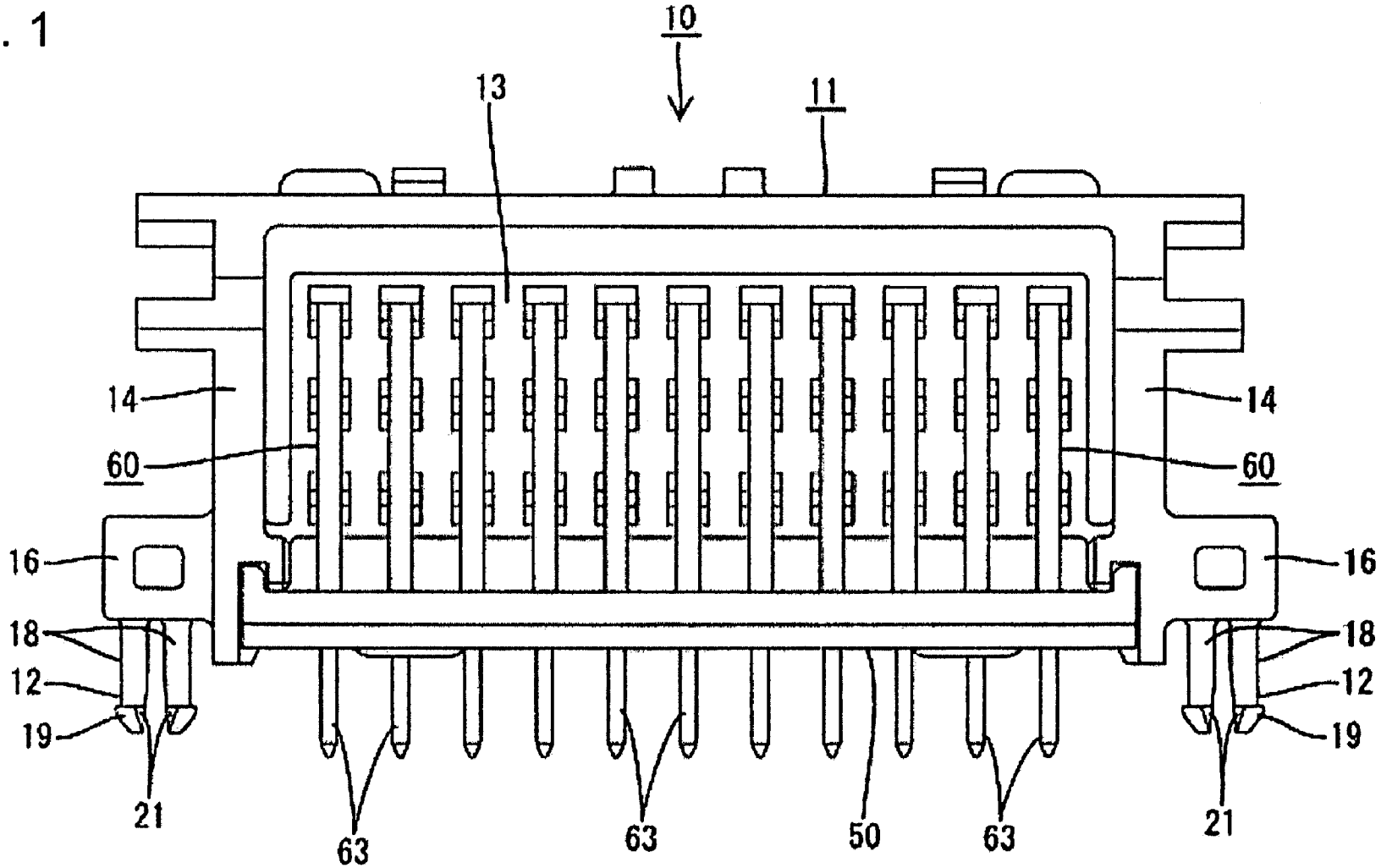
FIG. 1 is a rear view of a connector for use in a substrate of an embodiment of the present invention.
Figure 2:
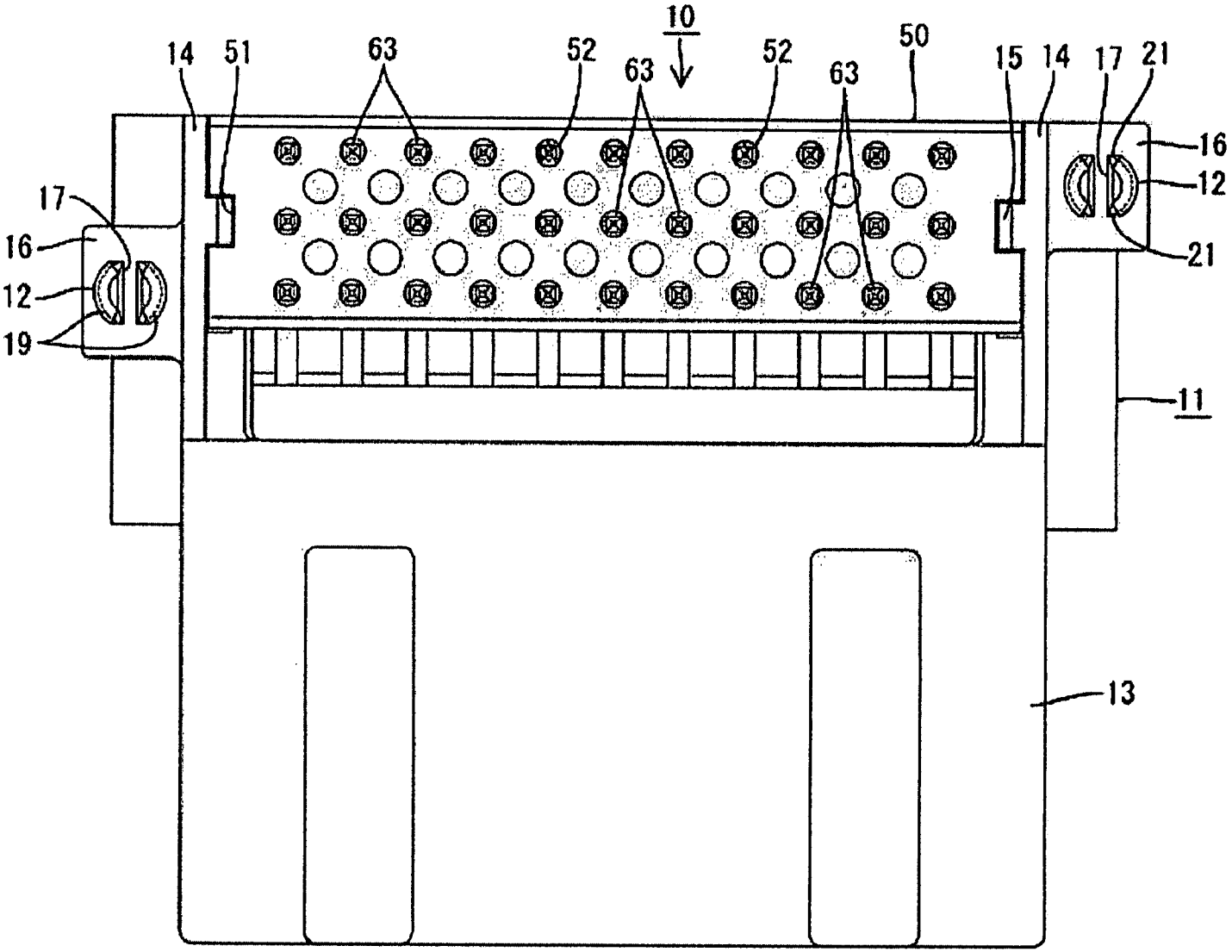
FIG. 2 is a bottom view of the connector for use in the substrate.
Figure 3:
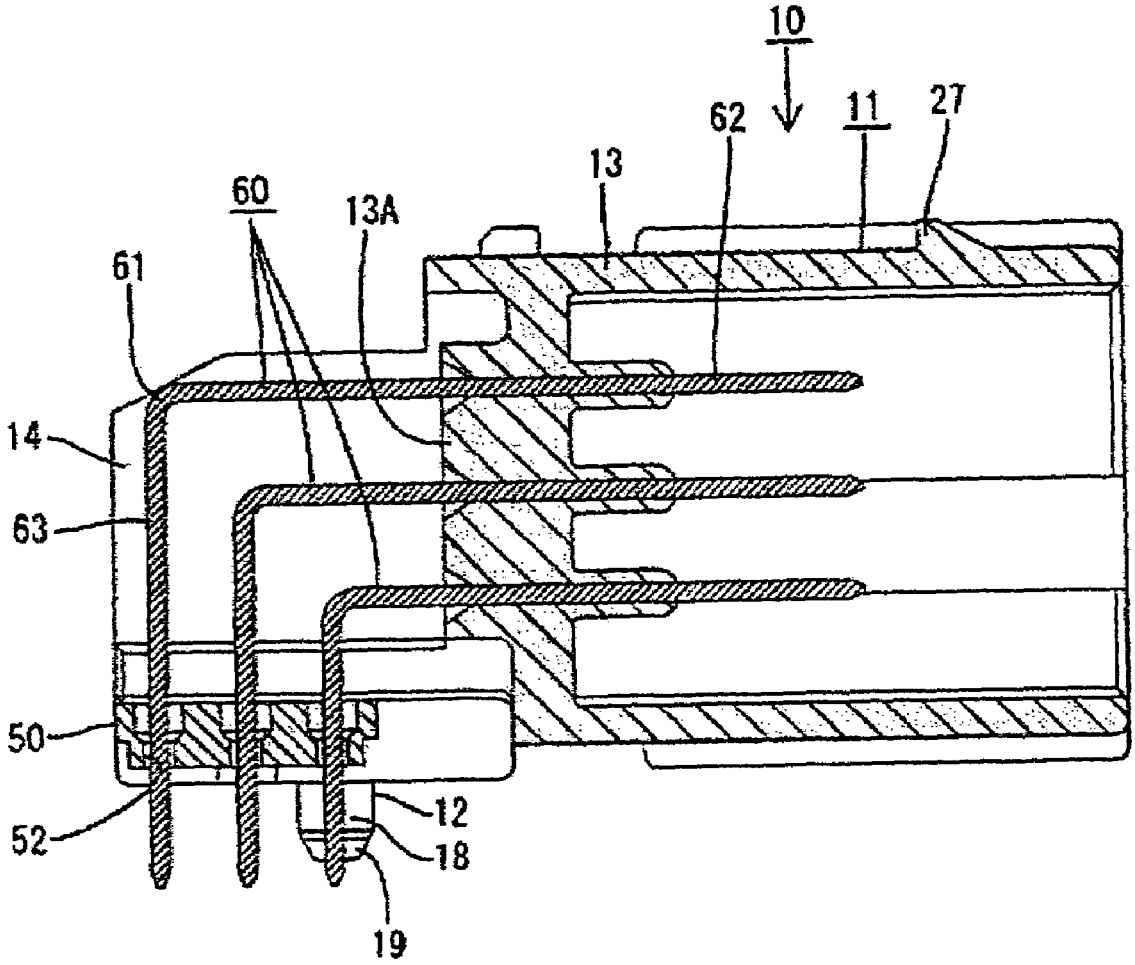
FIG. 3 is a sectional view of the connector for use in the substrate.

A connector in accordance with the invention is identified by the numeral 10 in FIGS. 1 through 9. The connector 10 has a housing 11 and metal terminal fittings 60 are accommodated in the housing 11. The housing 11 has a fixing part 12 for fixing the housing 11 to a circuit substrate 70. It is to be noted that the reference to the vertical direction in the following description is based on the orientation shown in FIG. 1 and that the right-hand side in FIG. 3 is referred to herein as the front.

Each terminal fitting 60 is formed of a heat-resistant conductive metal, such as a copper alloy or the like. As shown in FIG. 3, each terminal fitting 60 has a bend 61 midway in a longitudinal direction thereof. A terminal connection portion 62 extends forward from the bend 61 and can be connected with a mating terminal fitting (not shown). A substrate connection portion 63 is disposed at the end of the terminal fitting 60 opposite the terminal connection portion 62 and can be connected with the substrate 70. The terminal connection portion 62 is disposed approximately horizontally and the substrate connection portion 63 is disposed approximately vertically. The lengths of the terminal fittings 60 are different from one another, and shorter terminal fittings 60 are inward from the longer terminal fittings 60.

Figure 9:
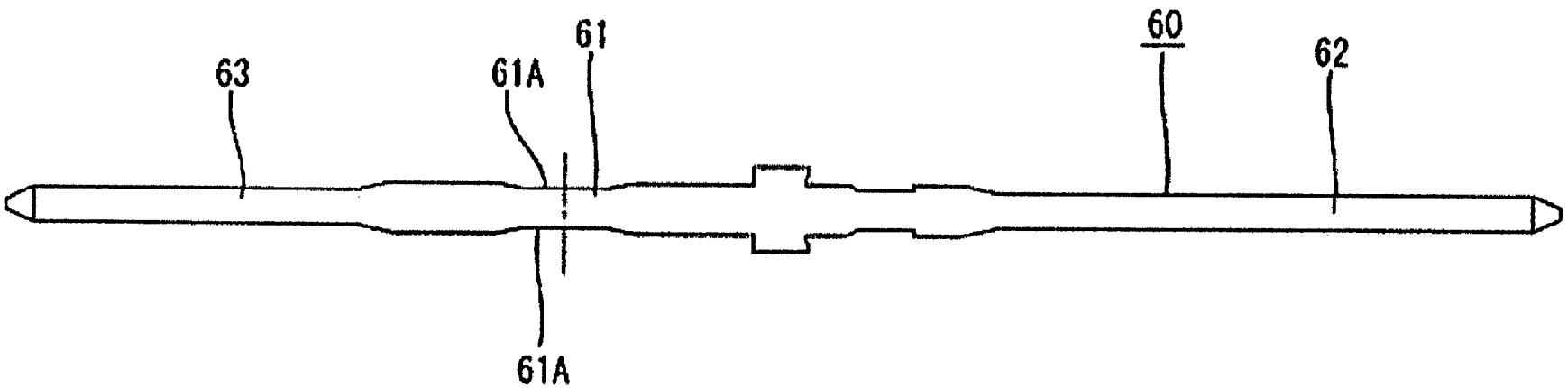
FIG. 9 is a plan view of a terminal metal fitting before it is bent.

The bend 61 is formed at the one-dot chain line shown in FIG. 9 and in an area that is narrower than the substrate connection portion 63 and the terminal connection portion 62. In other words, the terminal fitting 60 has concave side edges 61A prior to forming the bend 61 between the substrate connection portion 63 and the terminal connection portion 62. This configuration has been devised because side edges of the metal bulge out laterally during the operation of forming the bend 61. As a result, it is impossible to have a sufficient pitch between the terminal fittings 60 in the widthwise direction of the housing 11 if the terminal fittings 60 were of constant width prior to bending, and a short circuit could occur. However, the concave edges 61A narrow the terminal fitting prior to forming the bend 61 and hence the concave edges 61A absorb a portion bulge created by forming the bend 61. Thus, the substrate connection portion 63 and the terminal connection portion 62 do not project out from the position of both side edges thereof.

The housing 11 is made of a synthetic resin material. The terminal fittings 60 are mounted in the housing 11 by press fit or insertion. The housing 11 has a square pillar-shaped receptacle 13 that opens forward. The receptacle 13 can be fit on a mating housing (not shown). A lock 27 projects from an upper surface of the receptacle 13 for locking the mating housing to the housing 11. The terminal connection portions 62 of the terminal fittings 60 project forward inside the receptacle 13. The terminal fittings 60 are supported by a rear wall 13A of the receptacle 13 at three vertical stages, with the longest terminal fitting 60 mounted at the upper stage, the intermediate terminal fitting 60 mounted at the intermediate stage, and the shortest terminal fitting 60 mounted at the lower stage. The bend 61 of each terminal fitting 60 is rearward from the rear wall 13A of the receptacle 13 and the substrate connection portion 63 extends down from the bend 61.

Left and right side walls 14 extend from both widthwise sides of a rear part of the housing 11. The bends 61 and the substrate connection portions 63 of the terminal fitting 60 are disposed in a protected state between the side walls 14. A receiving portion 15 is provided at a lower portion of an inner surface of each side wall 14 for locking an alignment plate 50 to the housing 11.

The alignment plate 50 is a narrow wide plate made of a synthetic resin and is mounted horizontally on a lower rear part of the housing 11. Locking portions 51 are formed at both sides of the alignment plate 50 in the width direction and can be locked to the receiving portion 15 for mounting the alignment plate 50 on the housing 11. Positioning holes 52 penetrate the alignment plate 50 in a thickness direction at positions that match through-holes (not shown) formed through the substrate 70. The substrate connection portion 63 of each terminal fitting 60 is inserted into the corresponding positioning hole 52 when the substrate connection portion 63 is in position and is guided correctly to the corresponding through-hole of the substrate 70. The substrate connection portion 63 inserted into the corresponding through-hole is connected to a conductive circuit path on the substrate by soldering.

Figure 6A:
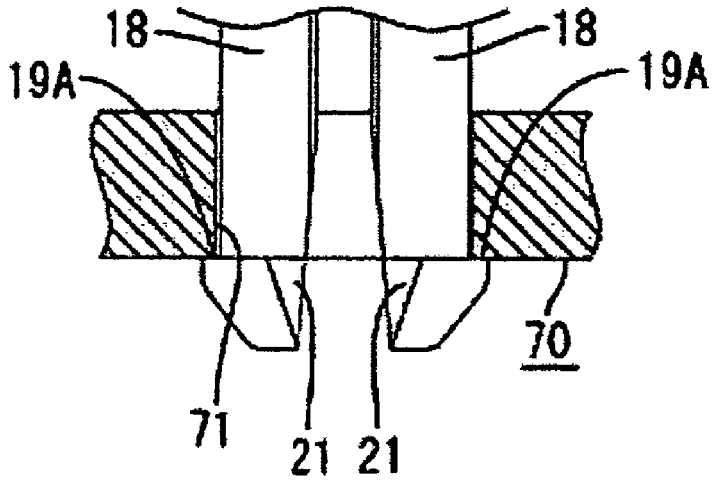
FIG. 6A is a main portion-enlarged front view of a state in which the fixing part has been normally inserted into the through-hole of the substrate.
Figure 6B:
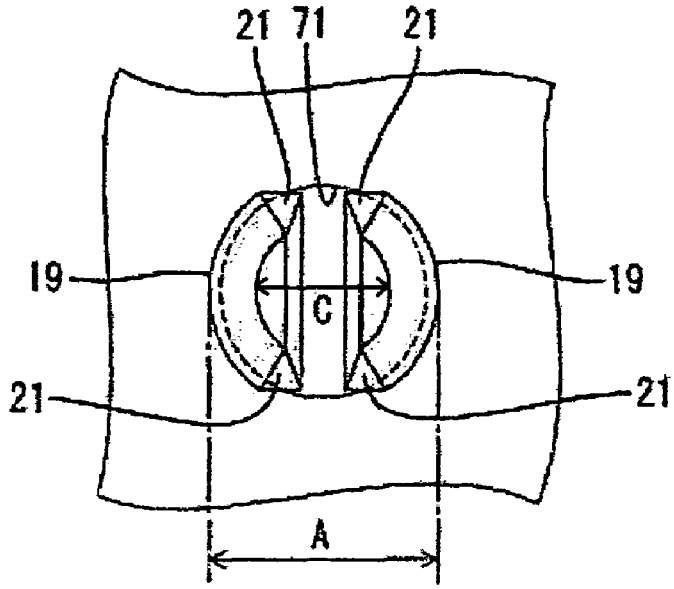
FIG. 6B is a main portion-enlarged bottom view of the state in which the fixing part has been normally inserted into the through-hole of the substrate.
Figure 7:
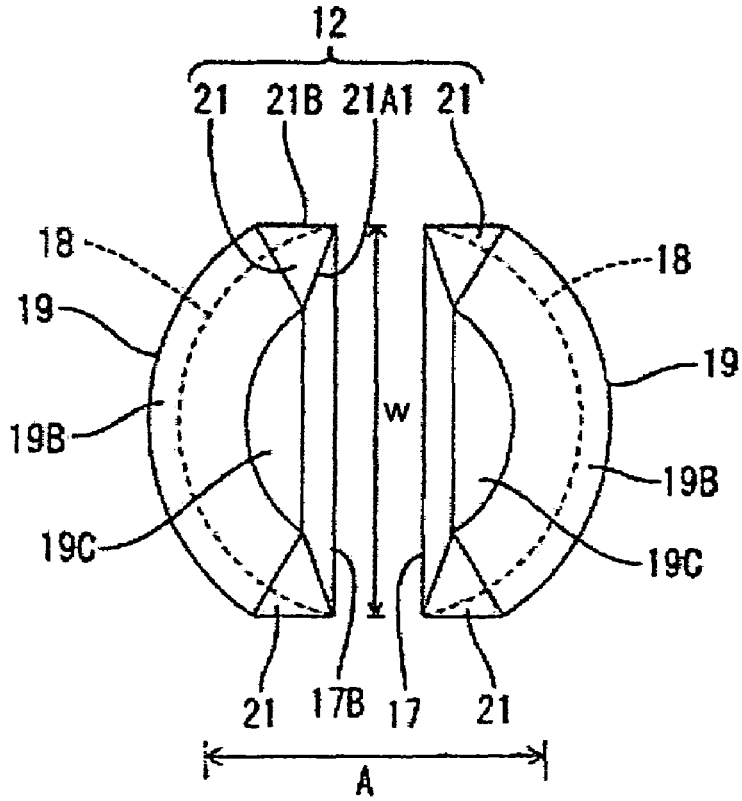
FIG. 7 is an enlarged bottom view of the fixing part.
Figure 8:
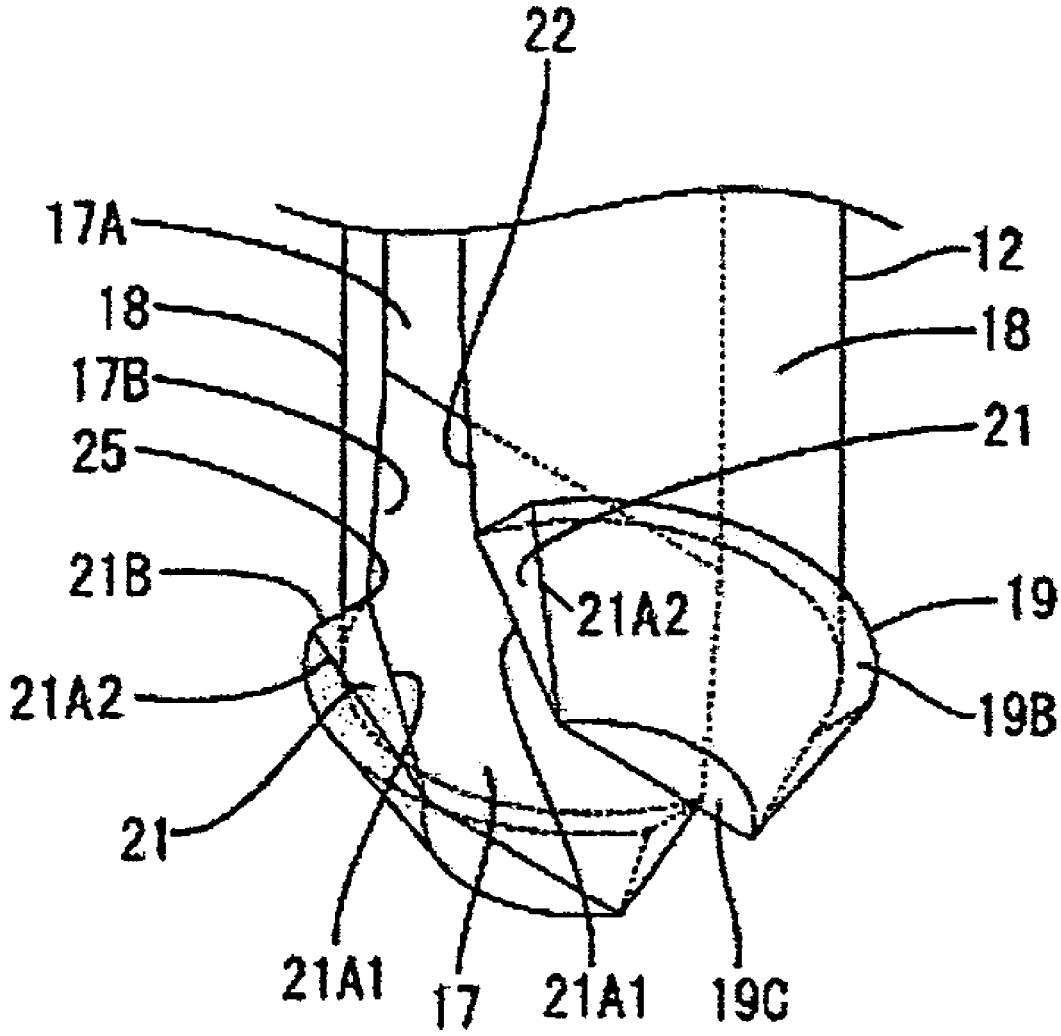
FIG. 8 is an enlarged perspective view of the fixing part.

Left and right bases 16 project unitarily out widthwise from the sides of the side walls 14. The fixing parts 12 for mounting the housing 11 on the substrate 70 extend unitarily down from lower surfaces of the respective bases 16. As shown in FIG. 2, the bases 16 and the fixing parts 12 are shifted longitudinally on the housing 11 with respect to a widthwise straight line. As shown in FIGS. 6(A), 6(B), 7 and 8, the fixing part 12 has a pillar shape with an axial direction that extends vertically and normal to the substrate 70. The fixing part 12 is cut diametrically to form an expanding slot 17 that extends longitudinally along the entire length of the fixing part 12 from a distal end surface 19C thereof. Each expanding slot 17 extends in a front to rear direction and divides the fixing part into left and right legs 18. Each leg 18 includes a vertical surface 17A and a tapered surface 17B of the expanding slot 17. The vertical surfaces 17A extend substantially parallel to the axis of the fixing part 12 from a proximal end of the fixing part 12 to a midway position thereof and substantially parallel to a front to rear direction. The tapered surfaces 17B taper gradually away from one another in the slot 17 from the midway position to the distal end surface 19C. The vertical surface 17A of each leg 18 has front and rear edges 22 that extend parallel to the axis of the fixing part 12. The edges 22 are spaced from one another by a width dimension "w" measured perpendicular to the axis of the fixing part 12 and parallel to a front to rear direction of the housing 11, as shown in FIG. 7. The width "w" is slightly less than the inside diameter "d" of an approximately cylindrical through-hole 71 in the substrate 70. Additionally, a diameter "d" of the fixing part 12 passing perpendicularly through the vertical surface 17A of the slot 17 is approximately equal to the inside diameter "d" of the through-hole 71 in the substrate 70.

The left and right legs 18 of the fixing part 12 are capable of deforming resiliently in directions DD to narrow the expanding slot 17 and to reduce the diameter "d" at more distal positions on the fixing part 12. Both legs 18 are symmetrical with respect to the expanding slot 17 and are approximately semicircular in section. The tapered surface 17B of the expanding slot 17 becomes approximately vertical when the legs 18 flex inward so that the legs 18 do not interfere with each other.

Figure 4A:
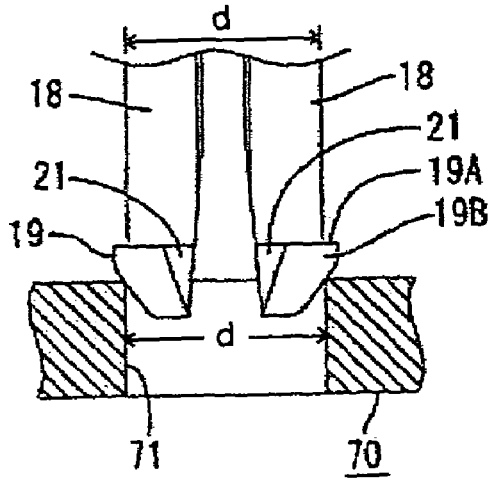
FIG. 4A is a main portion-enlarged front view of a state in which a fixing part is started to be inserted into a through-hole of the substrate.
Figure 5A:
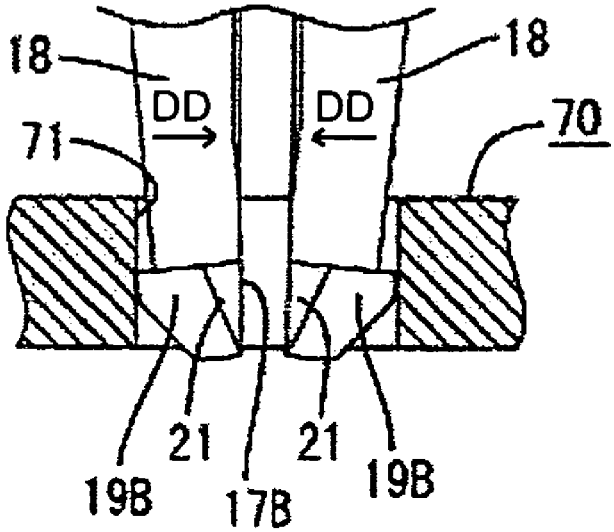
FIG. 5A is a main portion-enlarged front view of a state in which the fixing part is being inserted into the through-hole of the substrate.

Locking projections 19 project radially out orthogonal to the axial direction on a peripheral surface at the distal ends of both legs 18. However, the locking projections 19 are not formed on the surfaces of the legs 18 that define the expanding slot 17. A sliding-contact surface 19B is formed circumferentially on an outer peripheral surface of each locking projection 19 and extends down towards the distal end surface 19C with a decreasing diameter. Thus, each sliding-contact surface 19B effectively defines part of a frustum-shaped surface. A minimum diameter "C" of the sliding-contact surface 19B is substantially adjacent the distal end surface 19C and is less than the inside diameter "d" of the through-hole 71 in the substrate 70. Accordingly, the sliding-contact surfaces 19B are dimensioned to contact the front edge of the through-hole 71 in the substrate 70, as shown in FIG. 4(A), and generate inward deflection of the legs 18 in directions DD. The sliding-contact surfaces 19B then slide in contact with the inner peripheral surface of the through-hole 71, as shown in FIG. 5(A), so that the locking projections 19 can penetrate the through-hole 71. A locking surface 19A is formed circumferentially on an upper end of the locking projection 19 for locking to the substrate 70. More particularly, an outside diameter "A" passing through the axis of the fixing part 12 and normal to the planes defined by the vertical surfaces 17A of the fixing part 12 exceeds the inside diameter "d" of the through-hole 71. The locking surface 19A initially is substantially normal to the axis of the fixing part 12, as shown in FIG. 4(A), so that any point of the locking surface 19A has an equal height from the distal end surface 19C. The legs 18 resiliently restore when the locking projections 19 pass through the through-hole 71. Thus, the locking surfaces 19A catch the substrate 70 at the rear edge of the through-hole 71, as shown in FIG. 6(A), for elastically locking the locking projections 19 to the substrate 70 at the through-hole 71.

The distal end surface 19C of the locking projection 19 is flat and approximately horizontal. Opposite circumferential end portions of the peripheral surface of each locking projection 19 are cut to form front and rear noncontact surfaces 21 at opposite circumferential ends of the sliding-contact surface 19B. The front and rear noncontact surfaces 21 face generally in directions that are orthogonal to the deflecting directions of the legs 18 and are configured to avoid contact with the inner peripheral surface of the through-hole 71 while inserting the fixing part 12 into the through-hole 71 of the substrate 70. Specifically, each of the noncontact surfaces 21 becomes gradually wider from the distal end surface 19C to the locking surface 19A, with an apex thereof intersecting the distal end surface 19C to form a triangle. Each noncontact surface 21 is surrounded with first and second oblique side edges 21A1 and 21A2 formed at the periphery of the locking projection 19 and a base edge 21B formed at the locking surface 19A of the locking projection 19. The noncontact surface 21 and the inner tapered surface 17A of the slot 17 intersect at the first oblique side edge 21A1, so that the first oblique contact surface 21A1 is coincident with the inner tapered surface 17B of the slot 17. The base edge 21B of the noncontact surface 21 intersects the inner tapered surface 17B of the slot 17 at a substantially right angle, and also intersects the first oblique side edge 21A1 at the inner tapered surface 17B of the expanding slot 17. Therefore, the maximum front-to-rear dimension of the locking projection 19 measured along the tapered surface 17B of the slot 17 and normal to the axis of the fixing part 12 does not exceed the front-to-rear dimension "w" of each leg 18 at the expanding slot 17, as measured between the edges 22. The edges 22 of each leg 18 at the inner surface of the expanding slot 17 (FIG. 8) and the first oblique side edge 21A1 of the corresponding noncontact surface 21 intersect each other without forming an outward step. More particularly, the outward projection of the locking surface 19A that is seen in FIGS. 1, 4(A), 5(A) and 6(A) is not seen when the leg 18 is seen in the side view of FIG. 3. Thus the outer configuration of the leg 18 in the FIG. 3 view is continuous without forming a difference in level over the whole length thereof.

The connector 10 is assembled by fitting the terminal fittings 60 into the housing 11 by press fit or insertion. Thereafter the alignment plate 50 is mounted on the housing 11 from below. At this time, a deviation of the substrate connection portion 63 of each terminal fitting 60 is corrected by inserting the substrate connection portion 63 into the corresponding positioning hole 52.

Figure 4B:
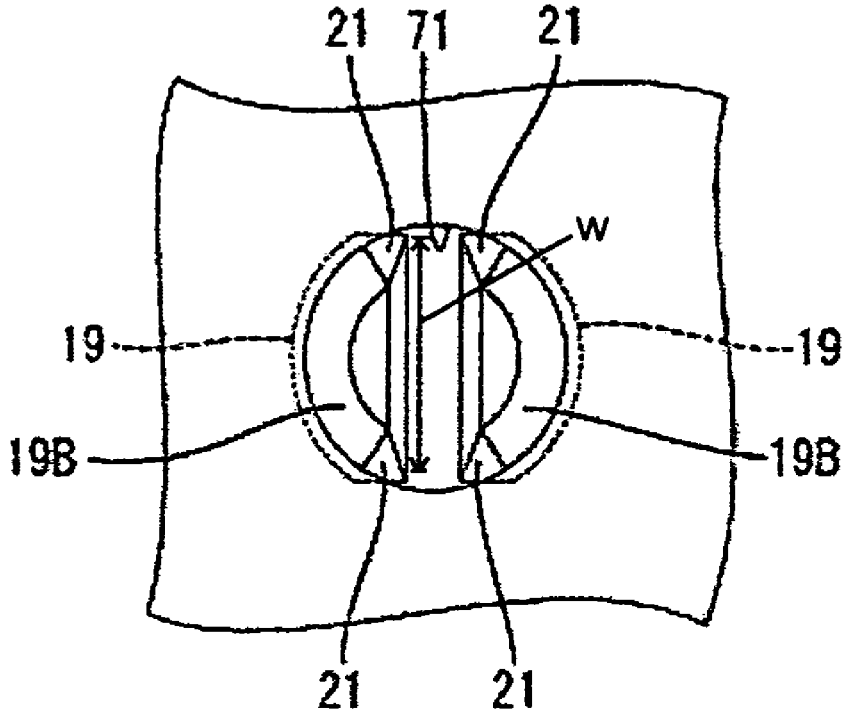
FIG. 4B is a main portion-enlarged bottom view of the state in which the fixing part is started to be inserted into the through-hole of the substrate.
Figure 5B:
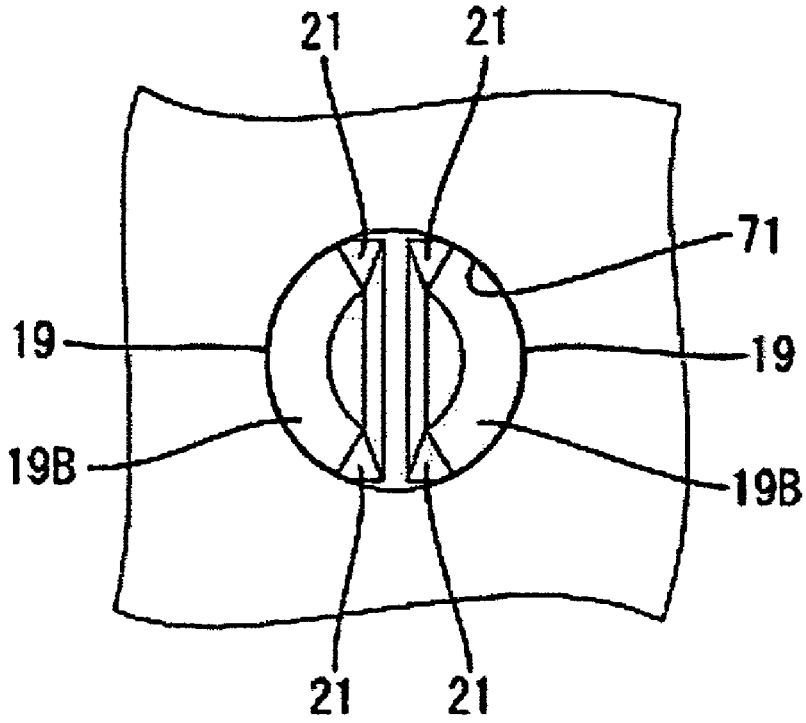
FIG. 5B is a main portion-enlarged bottom view of the state in which the fixing part is being inserted into the through-hole of the substrate.

To mount the connector 10 on the substrate 70, the distal end of each substrate connection portion 63 is inserted into the through-hole of the substrate 70. The left and right distal ends of the fixing parts 12 then are inserted simultaneously into the through-holes 71 of the substrate 70. As shown in FIGS. 4A and 4B, the sliding-contact surfaces 19B of the locking projections 19 circumferentially contact the entry edges of the through-holes 71 at an initial state of inserting the fixing part 12 into the through-hole 71. The insertion of the fixing part 12 into the through-hole 71 proceeds, as shown in FIG. 5A, so that the left and right legs 18 enter the through-hole 71 and elastically deform laterally in directions DD into the slot 17. As a result, the sliding-contact surfaces 19B of the locking projections 19 slide circumferentially on the inner peripheral surface of the through-hole 71. At this time, as shown in FIG. 5B, the noncontact surface 21 of the locking projection 19 is located inward from the inner peripheral surface of the through-hole 71 and does not contact the inner peripheral surface of the through-hole 71. When the fixing part 12 is inserted completely into the through-hole 71, as shown in FIG. 6A, the locking projection 19 moves beyond the exit of the through-hole 71, and both legs 18 elastically return to their original almost vertical posture. As a result, the locking surfaces 19A of the locking projections 19 circumferentially closely contact the rear edge of the through-hole 71 at its exit side. Thus, the fixing part 12 is locked to the substrate 70 and is caught by the back surface of the substrate 70. In this manner, the housing 11 is mounted on the substrate 70 and is prevented from separating from the substrate 70. Thereafter the substrate connection portion 63 of each terminal fitting 60 is connected with the circuit of the substrate by soldering.

As described above, at the step of inserting the fixing part 12 into the through-hole 71 of the substrate 70, the noncontact surface 21 of the locking projection 19 does not contact the inner peripheral surface of the through-hole 71. Thus it is possible to decrease a repulsive force that the fixing part 12 receives from the substrate 70 and hence decrease an insertion force. Consequently it is possible to reduce an operational burden and improve operability.

The noncontact surfaces 21 are at front and rear ends of the peripheral surface of the locking projection 19 in the circumferential direction thereof. That is, the noncontact surface 21 is on the peripheral surface of the locking projection 19 at portions thereof that confront the direction orthogonal to the deforming direction DD of both legs 18. Thus, the locking area of the locking projection 19 in the deforming direction DD does not decrease, and the fixing part 12 does not decrease its force of holding the housing 11 on the substrate 70. In other words, as shown in FIG. 6B, a diameter D of the locking projection 19 in the deforming direction DD is secured. The locking area of the fixing part 12 is decreased slightly by the area of the noncontact surface 21. However, the fixing part 12 has no significant decrease in the force of holding the housing 11 on the substrate 70. Further because each noncontact surface 21 becomes gradually wider from the distal end surface 19C of the locking projection 19 to the locking surface 19A, the noncontact portion 21 guides the legs 18 into the through-hole 71.

Furthermore, the edges 22 at the outer front and rear extremes of the expanding slot 17 intersect the first oblique side edges 21A1 of the respective front and rear noncontact surfaces 21 at the position of the locking surface 19A of the locking projection 19 without forming a step or difference in level. Therefore, foreign matter will not be caught at this intersection and the locking projection 19 has no sharp corners that could be broken off. In addition, the construction of the locking projection 19 is simplified.

The invention is not limited to the embodiment described above with reference to the drawings. For example, the following embodiments are included in the technical scope of the invention. Further, modifications of the embodiments can be made without departing from the spirit and scope of the invention.

The expanding slot may be formed by a cross nick on the distal end of the fixing part to form two pairs of legs adjacent the expanding slot. However, one pair of the legs is sufficient, and the number of legs is not limited to a specific number.

According to the invention, the fixing part may be connected directly to the bottom surface of the housing without the intermediary of the base part.

The invention is applicable to a terminal fitting that is not bent.

The invention is applicable to a connector for use in a substrate with no alignment plate.

What is claimed is:

1. A connector mounting to a substrate having at least one through-hole, the through-hole having an inside diameter, the connector comprising: a housing for mounting on the substrate, at least one fixing part having a proximal end at the housing, a distal end projecting from the housing, a slot extending from the distal end towards the proximal end and defining at least two legs that are elastically deformable into said slot, side edges extending along each of said legs substantially from the proximal end towards the distal end and adjacent the slot, the side edges on each said leg being spaced apart by a distance no greater than the diameter of the through-hole, a lock substantially adjacent the distal end of each of said legs, each of said locks having a locking surface facing away from the distal end, a maximum cross-sectional dimension of the fixing part at the locking surface exceeding the diameter of the through-hole, a tapered sliding-contact surface extending from the locking surface towards the distal end of each of said locks and tapering to smaller cross-sectional dimensions towards the distal end, each of said locks having two noncontact surfaces formed respectively at opposite circumferential ends of each of the sliding contact surfaces and substantially adjacent the slot, the two noncontact surfaces of each said lock being spaced from one another at the slot by distances that are no greater than the diameter of the through-hole and each of said noncontact surfaces becoming gradually narrower towards the distal end, whereby the noncontact surfaces do not contribute to insertion forces for inserting the fixing part into the through-hole.

2. The connector of claim 1, wherein each of said locking surfaces is substantially orthogonal to an axis extending from the proximal end to the distal end of the fixing part.

3. The connector of claim 1 wherein each of said noncontact surfaces is substantially triangular and has a base edge at the locking surface.

4. The connector of claim 3, wherein each of said noncontact surfaces has a first side edge adjacent the slot and a second side edge adjacent the respective sliding contact surface, the first and second side edges intersecting one another substantially at the distal end.

5. The connector of claim 4, wherein a maximum distance between the base edges of the two noncontact surfaces on each of said locks is no greater than the diameter of the through-hole.

6. The connector of claim 1, wherein the fixing part is formed unitarily with the housing.

7. The connector of claim 1, wherein the housing has two fixing parts.

8. The connector of claim 1, wherein each of said sliding contact surfaces is a section of a substantially frustum shape.

9. A fixing part for mounting a housing to a substrate, a through hole extending through the substrate and having an inside diameter, the fixing part having first and second resiliently deformable legs separated from one another by a slot, two edges being formed on each of said legs adjacent the slot and being spaced apart by a distance that is no greater than the diameter of the through-hole, a lock on each of said legs substantially adjacent the distal end of said fixing part, each of said locks comprising:

a locking surface spaced from the distal end and facing oppositely from the distal end, a maximum cross-sectional dimension of the fixing part at the locking surface exceeding the diameter of the through-hole;

a tapered sliding-contact surface extending from the locking surface to the distal end; and noncontact surfaces at opposite circumferential ends of each of the sliding contact surfaces and substantially adjacent the slot, the noncontact surfaces of each of said locks being spaced from one another at the slot by distances that are no greater than the diameter of the through-hole and each of said noncontact surfaces becoming gradually narrower towards the distal end.

10. The fixing part of claim 9, wherein each of said locking surfaces is substantially orthogonal to an axis extending from the proximal end to the distal end of the fixing part.

11. The fixing part of claim 9 wherein each of said noncontact surfaces is substantially triangular and has a base edge at the locking surface.

12. The fixing part of claim 11, wherein each of said noncontact surfaces has a first side edge adjacent the slot and a second side edge adjacent the respective sliding contact surface, the first and second side edges intersecting one another substantially at the distal end.

13. The fixing part of claim 12, wherein a maximum distance between the base edges of the two noncontact surfaces on each of said locks is no greater than the diameter of the through-hole.

14. A fixing part for mounting to a substrate, a through hole extending through the substrate and having an inside diameter, the fixing part comprising:

first and second legs separated from one another by a slot and being resiliently deformable towards one another into the slot along deforming directions, two edges being formed on each of said legs adjacent the slot and being spaced apart by a distance that is no greater than the diameter of the through-hole;

first and second locks projecting out from the respective first and second legs substantially at the distal end of said fixing part, each of said locks having a locking surface facing away from the distal end, a maximum cross-sectional dimension of the fixing part at the locking surfaces and along the deforming direction exceeding the diameter of the through-hole, a tapered sliding-contact surface extending from the locking surface to the distal end, and noncontact surfaces extending between the sliding contact surfaces and the slot, the noncontact surfaces of each lock facing directions substantially transverse to the deforming directs and being spaced from one another at the slot by distances that are no greater than the diameter of the through-hole and each of said noncontact surfaces becoming gradually narrower towards the distal end.

15. The fixing part of claim 14 wherein each of said noncontact surfaces is substantially triangular and has a base edge at the locking surface.

* * * * *